US006809575B2

(12) United States Patent
Oddone et al.

(10) Patent No.: US 6,809,575 B2
(45) Date of Patent: Oct. 26, 2004

(54) TEMPERATURE-COMPENSATED CURRENT REFERENCE CIRCUIT

(75) Inventors: Giorgio Oddone, Rossiglione (IT); Lorenzo Bedarida, Vinercate (IT); Mauro Chinosi, Agrate (IT)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 10/407,622

(22) Filed: Apr. 3, 2003

(65) Prior Publication Data

US 2004/0051580 A1 Mar. 18, 2004

(30) Foreign Application Priority Data

Sep. 16, 2002 (IT) ..... TO2002A0803

(51) Int. Cl.[7] ..... G05F 1/10; G05F 3/02
(52) U.S. Cl. ..... 327/539; 327/540
(58) Field of Search ..... 327/530, 538–541, 327/543; 323/313, 316

(56) References Cited

U.S. PATENT DOCUMENTS 5,821,564 A * 10/1998 Wu et al. ..... 257/66
6,388,507 B1 * 5/2002 Hwang et al. ..... 327/538
6,392,472 B1 * 5/2002 Kobayashi et al. ..... 327/541
6,407,622 B1 * 6/2002 Opris ..... 327/539
6,452,437 B1 * 9/2002 Takeuchi et al. ..... 327/513
6,501,299 B2 * 12/2002 Kim et al. ..... 326/83
2003/0160649 A1 * 8/2003 Nakai ..... 327/540

OTHER PUBLICATIONS

B. Razavi, *Design of Analog CMOS Integrated Circuits*, McGraw–Hill Series in Electrical and Computer Engineering, pp. 379 and 391, 2001.

* cited by examiner

*Primary Examiner*—Quan Tra
(74) *Attorney, Agent, or Firm*—Sierra Patent Group, Ltd.

(57) ABSTRACT

A circuit comprises an amplifier having first output node comprising a first n-channel MOS transistor and a second output node comprising a second n-channel MOS transistor. A first p-channel MOS transistor is coupled to a supply potential, and the second output node. A first PNP bipolar transistor is coupled to the first p-channel MOS transistor through a first resistor and to the second n-channel MOS transistor and to ground. A second PNP bipolar transistor is coupled to the first p-channel MOS transistor through a second resistor in series with a third resistor and to ground. The first n-channel MOS transistor is coupled to a common node between the second and third resistors. A third n-channel MOS transistor is coupled to the first p-channel MOS transistor, to ground through a fourth resistor, and to either a reference potential or to the common node between the second and third resistors.

10 Claims, 2 Drawing Sheets

TEMPERATURE-COMPENSATED CURRENT REFERENCE CIRCUIT

PRIORITY CLAIM

This application claims priority to Italian Application Serial Number 2002A000803, filed Sep. 16, 2002.

BACKGROUND OF THE INVENTION

1. Field of the Invention

The present invention relates to current-reference circuits. More particularly, the present invention relates to temperature-compensated current-reference circuits.

2. The State of the Art

In integrated circuit applications such as flash memory, EEPROM, and others, certain circuits require a constant current that is independent of variations in temperature and supply voltage.

Numerous techniques exist for designing current references to be unaffected by supply-voltage and temperature variations. One way to generate a current reference that is robust with respect to supply-voltage variation but sensitive to temperature variation is to employ two current mirrors and a resistor as shown in FIG. 1. The current through p-channel MOS transistor 10 is mirrored through p-channel MOS transistor 12. The current through n-channel MOS transistor 14 is mirrored through n-channel MOS transistor 16, having resistor 18 coupled between its source and ground.

The circuit of FIG. 1 has a current variation of up to about 30% as a function of temperature. For circuits of the type shown in FIG. 1, the current generated is equal to:

$$I=n*Ut*\ln(M)/R$$

if the transistors are in weak inversion and $$I=(2/Kn*R^2)*\psi(I)$$

if the transistors are in strong inversion. In both cases the current is independent of the supply voltage but temperature variation is uncompensated.

Another way to provide a current reference is to employ a resistor and a bipolar transistor as shown in FIG. 2 to generate a current that is proportional to both absolute temperature and the temperature coefficient of the resistor.

P-channel MOS transistors 20 and 22 have their gates driven from the output of operational amplifier 24. PNP bipolar transistor 26 has its emitter coupled to the drain of p-channel MOS transistor 20 and its base and collector coupled to ground. PNP bipolar transistor 28 has its emitter coupled to the drain of p-channel MOS transistor 20 through resistor 30 and its base and collector coupled to ground. One input of operational amplifier 24 is coupled to the drain of p-channel MOS transistor 20 and the other input of operational amplifier 24 is coupled to the drain of p-channel MOS transistor 22.

In the circuit of FIG. 2, the current is given by:

$$I=(Ut/R)*\ln(N)$$

In order to provide temperature compensation, the temperature coefficient of the resistor must be opposite to Ut.

BRIEF DESCRIPTION OF THE INVENTION

The present invention provides a temperature-compensated current reference using only a MOS transistor and polysilicon resistor of the same type.

BRIEF DESCRIPTION OF THE DRAWING FIGURES

DETAILED DESCRIPTION OF THE INVENTION

Persons of ordinary skill in the art will realize that the following description of the present invention is only illustrative and not in any way limiting. Other embodiments of this invention will be readily apparent to those skilled in the art having benefit of this disclosure.

The purpose of the present invention is to obtain a constant current reference that is voltage-supply and temperature compensated. The present invention does not require any special components and is compatible with standard CMOS processes and uses a MOS transistor and polysilicon resistor of one type.

Figure 1:
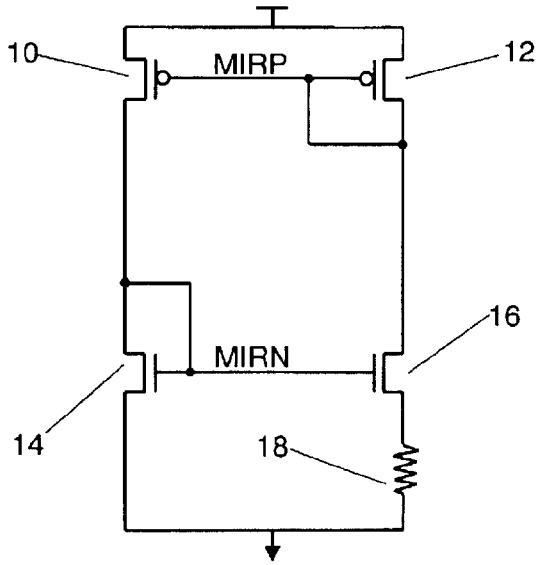
FIG. 1 is a schematic diagram of one prior-art current-reference circuit.
Figure 2:
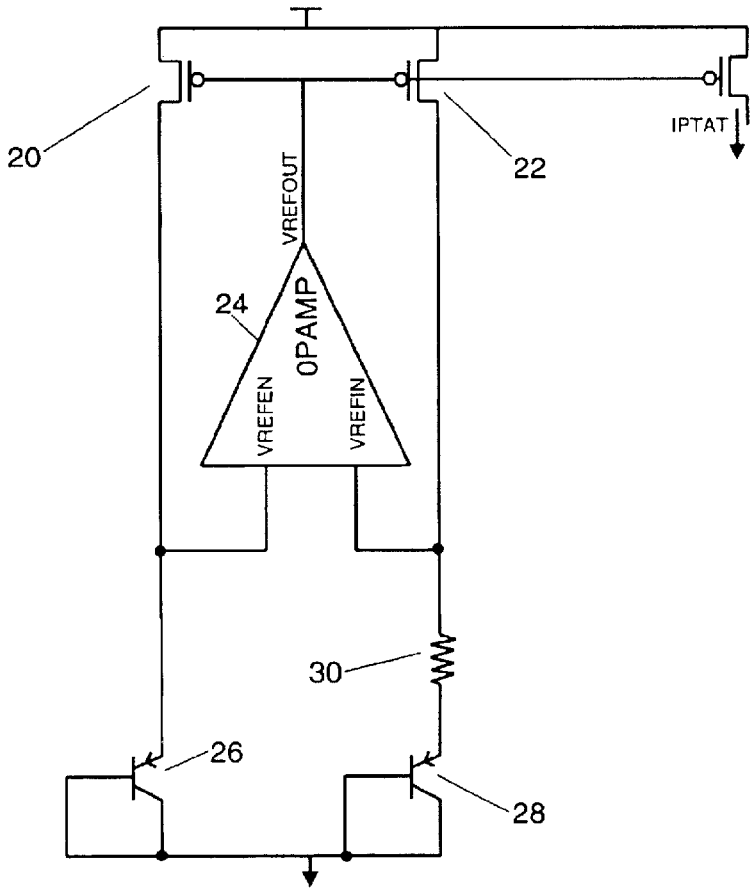
FIG. 2 is a schematic diagram of another prior-art current-reference circuit.
Figure 3:
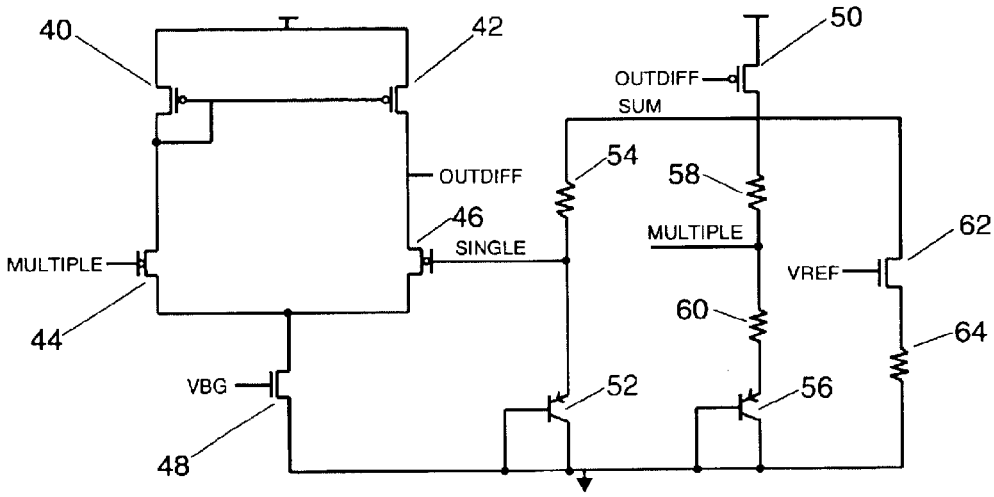
FIG. 3 is a schematic diagram of a first illustrative current-reference circuit according to the present invention.

Referring now to FIG. 3, a differential amplifier employs p-channel MOS current-source transistors 40 and 42, n-channel MOS input transistors 44 and 46, and n-channel bias transistor 48.

Figure 4:
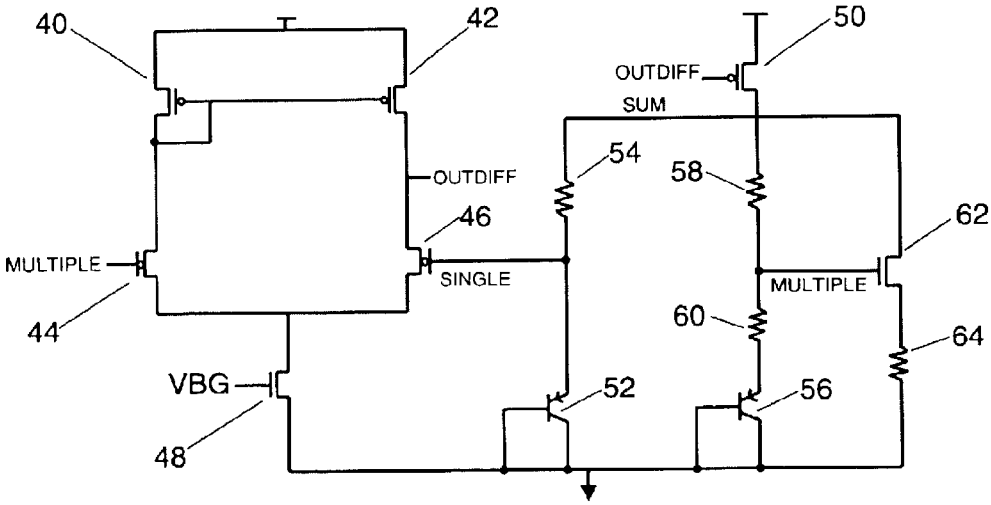
FIG. 4 is a schematic diagram of a second illustrative current-reference circuit according to the present invention.

P-channel MOS transistor 50 supplies current to PNP bipolar transistor 52 through resistor 54 as well as PNP bipolar transistor 56 through a voltage divider comprising resistors 58 and 60. In one illustrative embodiment of the circuit, resistor 54 and 60 may have resistance of about 12 KΩ, and resistor 58 may have a resistance of about 16 KΩ. P-channel MOS transistor 50 also supplies current to N-channel MOS transistor 62 in driving resistor 64 as a source follower. Resistor 64 may have a resistance of about 100 KΩ. The gate of n-channel MOS transistor 62 is driven from a reference voltage Vref that is a fixed value or that can be obtained in different manner as shown in FIG. 4 N-channel MOS transistor 62 is sized such that it operates in its subthreshold region.

The gate of n-channel MOS transistor 44 is driven from the common connection between resistors 58 and 60 (the "MULTIPLE" node). The gate of n-channel MOS transistor 46 is driven from the common connection of PNP bipolar transistor 52 and resistor 54.

The current through the bipolar transistors 52 and 56 is:

$$I_{Bip}=U_t/R2*[(R3/R1)*\ln(R3/R2)+\ln(N*R3)/R2)]$$

$U_t$ is equal to KT/q: This current is a positive function of Ut normalized with respect to resistance.

As will be appreciated by persons of ordinary skill in the art, $I_{Bip}$ increases when temperature rises and decreases when the temperature decreases.

The current through n-channel MOS transistor 62 is:

$$I_{62}=Id0*\exp(V_{GS62}/U_t)$$

$U_t$ is equal to KT/q. This current is a positive function of the $V_{gs}$ of n-channel MOS transistor 62 and a negative function of $U_t$.

In particular, the current through n-channel MOS transistor 62 decreases as temperature increases and increases as temperature decreases.

The total current through p-channel MOS transistor 50 is the sum of the currents through bipolar transistors 52 and 56 and n-channel MOS transistor 62:

$$I_{tot}=(U_t/R2)*[R3/R2+\ln((N*R3)/R2]+Id0*\exp(V_{GS62}/U_t)$$

If only the n-channel MOS transistor 62 was employed to obtain the temperature compensation, there would have been a linear dependence with respect to temperature contributed by the bipolar portion of the circuit and an exponential dependence contributed by the MOS portion of the circuit. This would not be adequate compensation because, when temperature increases, the current reduction due to the second term of the equation would be too much with respect the current increase related to the first term. With the addition of resistor 64 to n-channel MOS transistor 62, when the temperature increases and the current through n-channel MOS transistor 62 decreases, the excessive reduction of current through n-channel MOS transistor 62 is compensated by the increase of its Vgs, due to the presence of resistor 64. In this way the total current is independent of the supply voltage and a good temperature compensation is obtained.

As previously mentioned, the signal VREF supplied to the gate of MOS transistor 62 can be obtained as a fixed value as illustrated in FIG. 3, or can be also obtained as function of circuitry behavior. Referring now to FIG. 4, a schematic diagram shows another illustrative current-reference circuit according to the present invention. Persons of ordinary skill in the art will observe that the circuit of FIG. 4 is very similar to that of FIG. 3, and the same reference numerals have been used to identify corresponding elements. In the illustrative current-reference circuit of FIG. 4, the signal at the MULTIPLE node at the common connection of resistors 58 and 60 can be used to drive the gate of n-channel MOS transistor 62 instead of the fixed value VREF to obtain a good matching with respect to the bipolar behavior of the circuit. The signal at the MULTIPLE node is in fact a function of bipolar characteristics (FIG. 4) and provides a feedback loop in the circuitry.

The circuit works briefly as follows: when, for example, the temperature rises the bipolar current rises but the voltage value at the MULTIPLE node (and at the node "SINGLE" at the collector of PNP bipolar transistor 52) decreases (the coefficient of the VBE respect the temperature is negative −1.56 mv/C) so that the current through n-channel MOS transistor 62 decreases because of its dependence on temperature and also because the $V_{GS}$ of n-channel MOS transistor 62 is reduced because the voltage at the node MULTIPLE decreases. Therefore, the current through n-channel MOS transistor 62 compensates the increment of the current sunk by the bipolar transistors and, as already mentioned, the excessive $V_{GS}$ reduction is limited by the resistance of resistor 64.

In this way there are two components of the total current, one that rises with increasing temperature and the other that falls with increasing temperature.

It has been shown that with this circuitry of FIGS. 3 and 4, a good temperature compensation has been obtained both with and without feedback.

With this structure, as mentioned, there are several ways to obtain this kind of compensation and the solutions are different both for results both for design approach. In particular it is possible to use n-channel MOS transistor 62 in several cases. It has been said that the current dependence of n-channel MOS transistor 62 is exponential so that the resistance of resistor 64 has been introduced to compensate for the excessive current reduction when the temperature increases. At this point it is possible to decide to drive the gate of n-channel MOS transistor 62 with a fixed voltage from, for example, a BAND GAP reference as shown in FIG. 3) to achieve the best solution or to accept some error, using the signal MULTIPLE to drive the gate of n-channel MOS transistor 62 gate as shown in FIG. 4.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A current-reference circuit comprising:

a CMOS differential amplifier having first output node comprising a drain of a first n-channel MOS transistor and a second output node comprising a drain of a second n-channel MOS transistor;

a first p-channel MOS transistor having a source coupled to a supply potential, a gate coupled to said second output node, and a drain;

a first PNP bipolar transistor having an emitter coupled to said drain of said first p-channel MOS transistor through a first resistor and to a gate of said second n-channel MOS transistor, and a collector and a base both coupled to ground;

a second PNP bipolar transistor having an emitter coupled to said drain of said first p-channel MOS transistor through a second resistor in series with a third resistor, and a collector and a base both coupled to ground, a gate of said first n-channel MOS transistor coupled to a common node between said second and third resistors; and a third n-channel MOS transistor having a drain coupled to said drain of said first p-channel MOS transistor, a source coupled to ground through a fourth resistor, and a gate coupled to a fixed reference potential.

2. The current-reference circuit of claim 1 wherein:

said first and second resistors each have resistance of about 12 K ohms;

said third resistors has a resistance of about 16 K ohms; and said fourth resistor has a resistance of about 100 K ohms.

3. The current-reference circuit of claim 1 wherein said third n-channel MOS transistor is sized to operate in its subthreshold region.

4. The current-reference circuit of claim 1 wherein said fourth resistor is an n-doped polysilicon resistor.

5. The current-reference circuit of claim 1 wherein said CMOS differential amplifier comprises:

a first p-channel MOS load transistor having a source coupled to said supply potential, and a drain and a gate coupled to said drain of said first n-channel MOS transistor;

a second p-channel MOS load transistor having a source coupled to said supply potential, a gate coupled to said gate of said first p-channel MOS load transistor, and a drain coupled to said drain of said second p-channel MOS transistor; and an n-channel bias transistor having a source coupled to ground, a drain coupled to a source of said first n-channel MOS transistor and to a source of said second n-channel MOS transistor, and a gate coupled to a bias potential.

6. A current-reference circuit comprising:

a CMOS differential amplifier having first output node comprising the drain of a first n-channel MOS transistor and a second output node comprising the drain of a second n-channel MOS transistor;

a first p-channel MOS transistor having a source coupled to a supply potential, a gate coupled to said first output node, and a drain;

a first PNP bipolar transistor having an emitter coupled to said drain of said first p-channel MOS transistor through a first resistor and to a gate of said second n-channel MOS transistor, and a collector and a base both coupled to ground;

a second PNP bipolar transistor having an emitter coupled to said drain of said first p-channel MOS transistor through a second resistor in series with a third resistor, and a collector and a base both coupled to ground, a gate of said first n-channel MOS transistor coupled to a common node between said second and third resistors; and a third n-channel MOS transistor having a drain coupled to said drain of said first p-channel MOS transistor, a source coupled to ground through a fourth resistor, and a gate coupled to said gate of said first n-channel MOS transistor.

7. The current-reference circuit of claim 6 wherein:

said first and second resistors each have resistance of about 12 K ohms;

said third resistors has a resistance of about 16 K ohms; and said fourth resistor has a resistance of about 100 K ohms.

8. The current-reference circuit of claim 6 wherein said third n-channel MOS transistor is sized to operate in its subthreshold region.

9. The current-reference circuit of claim 6 wherein said fourth resistor is an n-doped polysilicon resistor.

10. The current-reference circuit of claim 6 wherein said CMOS differential amplifier comprises:

a first p-channel MOS load transistor having a source coupled to said supply potential, and a drain and a gate coupled to said drain of said first n-channel MOS transistor;

a second p-channel MOS load transistor having a source coupled to said supply potential, a gate coupled to said gate of said first p-channel MOS load transistor, and a drain coupled to said drain of said second p-channel MOS transistor; and an n-channel bias transistor having a source coupled to ground, a drain coupled to a source of said first n-channel MOS transistor and to a source of said second n-channel MOS transistor, and a gate coupled to a bias potential.

* * * * *